US006854682B1

(12) United States Patent
Nicolai

(10) Patent No.: US 6,854,682 B1
(45) Date of Patent: Feb. 15, 2005

(54) APPARATUS AND METHOD FOR WINDING OF WEBS

(75) Inventor: Luc Marie Hubert Andre Nicolai, Heinsch (BE)

(73) Assignee: DuPont Teijin Films U.S. Limited Partnership, Wilmington, DE (US)

( * ) Notice: Subject to any disclaimer, the term of this patent is extended or adjusted under 35 U.S.C. 154(b) by 62 days.

(21) Appl. No.: 10/018,628

(22) PCT Filed: Jun. 14, 2000

(86) PCT No.: PCT/EP00/05436

§ 371 (c)(1),
(2), (4) Date: Apr. 16, 2002

(87) PCT Pub. No.: WO00/76894

PCT Pub. Date: Dec. 21, 2000

(30) Foreign Application Priority Data

Jun. 16, 1999 (EP) ..... 99401483

(51) Int. Cl.[7] ..... B65H 18/10; B65H 18/26
(52) U.S. Cl. ..... 242/547; 242/541.6
(58) Field of Search ..... 242/541.6, 541.5, 242/547, 541.4, 541.7

(56) References Cited

U.S. PATENT DOCUMENTS 1,741,520 A * 12/1929 Jagenberg ..... 242/541.5
2,984,426 A * 5/1961 Johnson ..... 242/541.6
3,410,499 A * 11/1968 Schmidt ..... 242/547
3,670,980 A * 6/1972 Mukai et al. ..... 242/547
5,039,023 A 8/1991 Hagens et al.
6,527,218 B1 * 3/2003 Cramer et al. ..... 242/541.5

FOREIGN PATENT DOCUMENTS

DE 43 43 173 A1 6/1995
EP 0147115 * 7/1985
EP 0514226 * 11/1992
EP 0670277 * 9/1995

OTHER PUBLICATIONS

Patent Abstracts of Japan, vol. 95, No. 8, Sep. 29, 1995 & JP 07 112854 A (Mitsubishi Heavy Ind Ltd), May 2, 1995, abstract.*

Y. Bae Chang, F. W. Chambers, J. J. Shelton, Air Entrainment with A Forced–Loaded Nip Roller, Web Handling Research Center, Oklahoma State University, May 1994, pp. 33 to 35.

* cited by examiner

*Primary Examiner*—John M. Jillions

(57) ABSTRACT

Apparatus for winding a web (1) on a winding roll (2), comprises at least a first and a second roll (3, 4) and a third roll (5), said first roll being located on one side and said second roll and said third roll being located on the other side of the path of said web in course of winding on said winding roll. Said first and second rolls and said third roll are movable towards each other and towards said winding roll, so that said third roll get sandwiched between said winding roll on one hand and said first and second rolls on the other hand, said web passing between said first roll and said third roll and then between said third roll and said winding roll. Means cause said third roll to position and align freely between said first and second rolls and said winding roll.

32 Claims, 8 Drawing Sheets

APPARATUS AND METHOD FOR WINDING OF WEBS

FIELD OF THE INVENTION.

The invention relates to an apparatus and a method for winding of webs.

BACKGROUND OF THE INVENTION

In general, webs such as thin polyester foils or other sheet materials are manufactured in a continuous process and the final products are wound up on rolls for storage and transportation.

During the operation of winding the web on a roll, it is wished to ensure a homogeneous winding on the roll (i.e. without wrinkles or puckers) and to trap as less as possible air between each web layer on the roll.

The problem is particularly acute for (ultra) thin films with thicknesses as low as micron size and speeds up to 1000 m/min.

In the prior art, webs, especially in case of thin ones, are usually wound at high velocities (i.e. more than a few hundred meters per minute) with the help of a nip roller (also called packroll) to prevent excessive air entrainment.

In p. 33 to 35 of Air Entrainment with A Forced-Loaded Nip Roller, Y. Bae Chang, F. W. Chambers, J. J. Shelton, Web Handling Research Center, Oklahoma State University, 05/1994, it is taught that:

(aa) to keep the amount of air entrainment under a certain level at high speed operation, the most effective way is to reduce the diameter of packroll;

(bb) if the packroll (or its covering) is softer than the winding roll and too much air is entrained, then the problem can be solved by using harder materials for the packroll;

(cc) the amount of entrainment air is not very effectively reduced by increasing the nip loading and if said loading is increased too much, other winding problems can occur.

Furthermore, this document teaches that there may be practical problems or limitations in reducing the size of packrolls, for example, the packroll may become too flexible if it is too thin. However, it suggests to design slender packrolls because of its importance in air entrainment and gives two examples of possible design changes by way of schematic drawings. A first drawing shows a slender roll between a roll and a winding roll, the web passing from the roll to the slender roll and then to the winding roll. A second drawing shows a slender roll between two rolls and a winding roll, the web passing from one of those rolls to the slender roll and then to the winding roll.

However, this document does not give enough hints for to put those principles into practice, i.e. there are several practical problems that are neither solved nor mentioned. A first problem is to ensure the correct position of the slender roll between the roll(s) and the winding roll since the slender roll becomes flexible due to its low diameter. Another problem is to ensure that the tangential speed of the slender roll and of the rolls is identical at each point there between over their length in order to avoid friction on the web. Another problem is to ensure the spreading of the web before winding it on the winding roll, i.e. wrinkles may remain on the web once wound on the winding roll. A further problem is to allow an easy initiation of the winding of the web: the difficulty consists in passing the web between the roll and the slender roll and between the slender roll and the winding roll. Another further problem is to apply a pressure distribution over the width of the winding roll that results in a uniform air exclusion.

The purpose of the present invention is to provide an apparatus and a method for winding webs on winding rolls which overcome these problems.

SUMMARY OF THE INVENTION

The object of the present invention is to provide an apparatus and a method for winding of webs on winding rolls ensuring a good and uniform air exclusion, no distortion of the web, a good spreading of the web as well as an easy initiation of the winding thereby improving the speed and the quality of the winding.

DETAILED DESCRIPTION OF THE INVENTION

FIGS. 1*a* to 1*e* show the operation of a preferred embodiment of an apparatus according to the invention from the open state allowing the initiation of the winding on the winding roll until the working position for ensuring a winding of high quality for thin webs (down to about a micron for polyester webs) at high speeds (up to 1000 m/min).

Figure 1A:
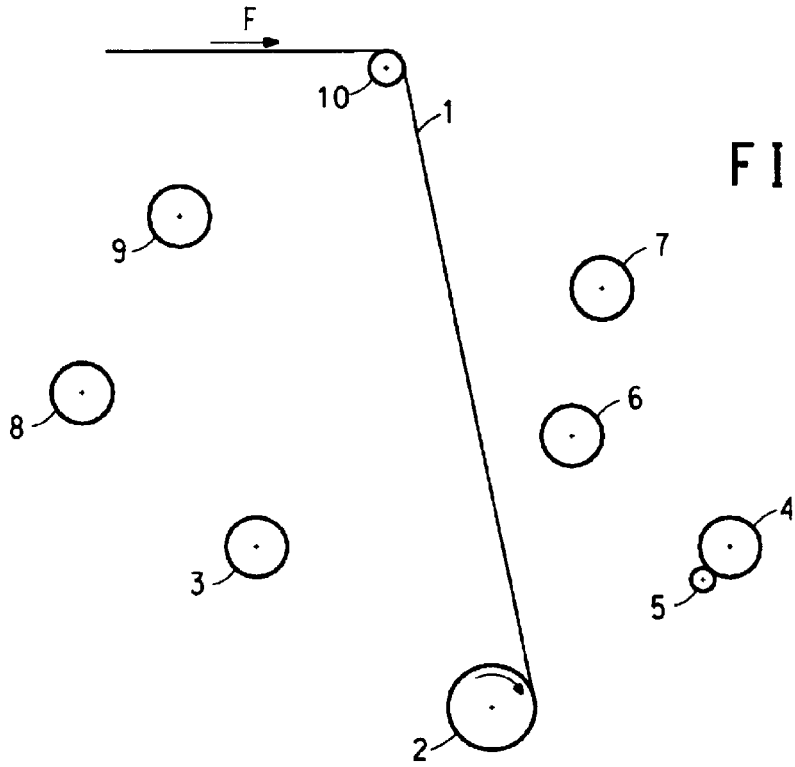
FIGS. 1*a* to 1*e* are schematic side views of the rolls of an apparatus according to the invention, illustrating the operating of said apparatus.

FIG. 1*a* shows an apparatus according to the present invention in open position. A web 1 such as a polyester foil arrives from a conveyance direction indicated by arrow F. As the apparatus is in open position, the web is diverted towards a winding roll 2 (located in a lower position) via, for example, an idle roll 10 (which is fixed). The path between idle roll 10 and winding roll 2 is free in order to allow an easy initiation of the winding of web 1 on winding roll 2, either manually or by automatic means. A first set of rolls (3, 8, 9) is provided on one side of said path. Said first set of rolls is carried by a first movable carriage 11 (not shown). A second set of rolls (4, 5, 6, 7) comprising a slender roll 5, is provided on the side opposite to said first set of rolls with respect to said path. Said second set of rolls is carried by a second movable carriage 12 (not shown).

Figure 1B:
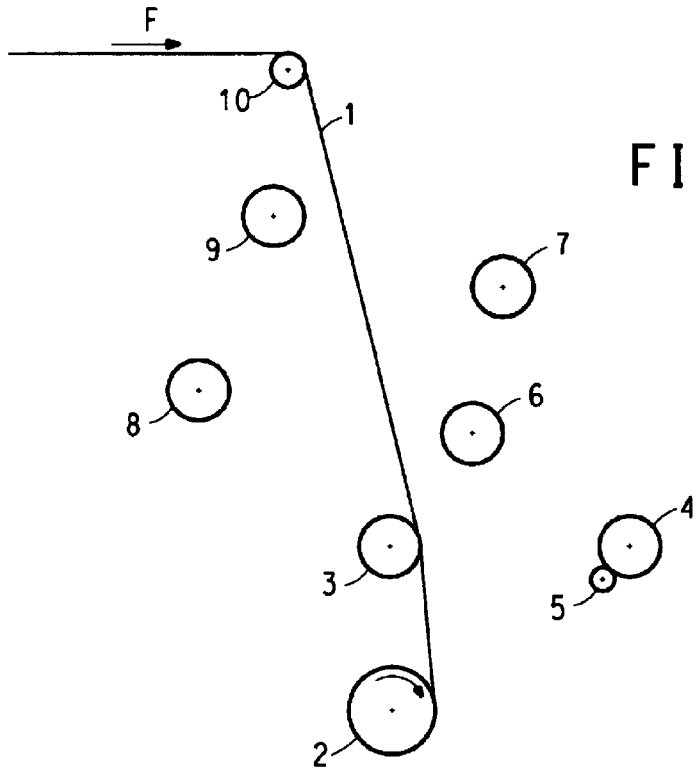

Once the winding of web 1 on winding roll 2 is initiated, first carriage 11 is moved towards the portion of web 1 extending between idle roll 10 and winding roll 2, until a position in which roll 3 abuts web 1. This situation is illustrated in FIG. 1*b*. Before abutting web 1, roll 3 is preferably caused to rotate with a tangential speed and in a direction substantially corresponding to those of the displacement of web 1. Rolls 8 and 9 are shown not abutting web 1, however, it may be the case.

Figure 1C:
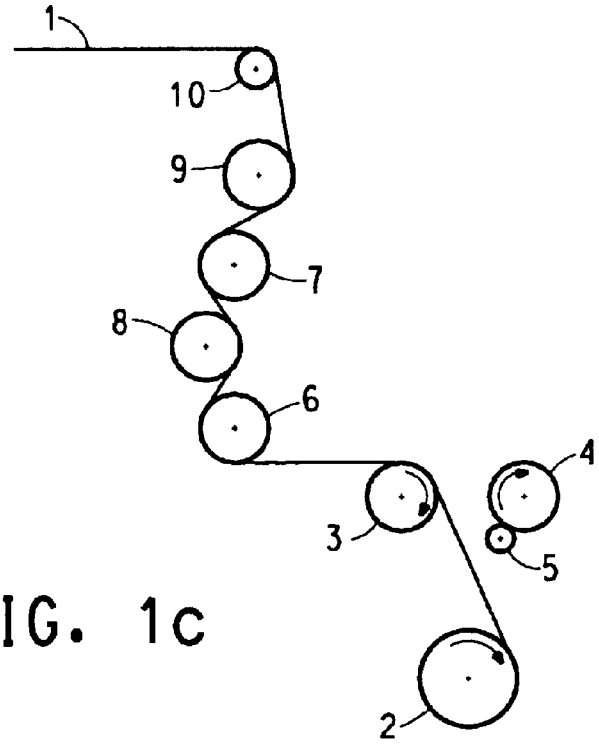

Once at the stage of FIG. 1*b*, second carriage 12 is moved towards web 1 until a defined position in which roll 3 and roll 4 are near, but not into contact with each other. This situation is illustrated in FIG. 1*c*. For sparing operating time, this step (i.e. moving second carriage 12 towards web 1) may be realized simultaneously with the previous one consisting in the displacement of carriage 11 towards web 1. The simultaneous displacement of first carriage 11 and second carriage 12 is indeed preferred. In the position of FIG. 1*c*, slender roll 5 is preferably located under roll 4 slightly towards roll 3, i.e. slender roll 5 abuts roll 4 but does not abut roll 3. Neither roll 4 nor slender roll 5 abut web 1. Rolls 8 and 9 of the first carriage 11 and rolls 6 and 7 of the second carriage 12 are located so as to form a jaw having been closed on the web. More precisely, roll 7 of the second carriage 12 is located substantially between roll 8 and roll 9 of the first carriage 11, and preferably in a narrow fashion but without being into contact with them. Roll 6 of the second carriage 12 is substantially located under roll 8 of the first carriage 1 land preferably close to the latter. Thus, web 1 is caused to abut roll 9 and to pass from roll 9 on roll 7, from roll 7 on roll 8, from roll 8 to roll 6 so as to form waves. The jaw defined by rolls 6, 7, 8 and 9, when closed onto web 1, isolates the winding tension from the incoming tension, which might be too low or too high. It is possible to vary the number of rolls forming said jaw. Further, before abutting web 1, rolls 6, 7, 8 and 9 are preferably caused to rotate each with a tangential speed and in a direction corresponding to that of web 1 (so as to avoid friction between said rolls and web 1); so, excessive tension on web 1 at the moment of being abutted by said rolls (which could arise if said rolls were idle rolls) are avoided. For web 1 having a width up to 2 meters and being conveyed at a speed up to 1000 meters/min, it is advantageous for rolls 6, 7, 8 and 9 to have a diameter of about 120 millimeters. Preferably, roll 6 is horizontally spaced from roll 3 so that web 1 passes from roll 6 to roll 3 in a substantially horizontal fashion. Furthermore, roll 3 and roll 4 are preferably interlocked in this position in order to avoid relative change of position between them as it will be described in relation with FIG. 3.

Once at the stage of FIG. 1*c*, roll 4 is preferably caused to rotate with a tangential speed corresponding to the speed of web 1 and in the same direction than roll 3. As a result, roll 4 causes slender roll 5 to rotate by friction driving because slender roll 5 abuts roll 4. Slender roll 5 is then moved upwards along the circumference of roll 4 until it abuts roll 3 through web 1. Hence, slender roll 5 is in abutment both with roll 3 (through web 1) and roll 4, and, as a consequence, slender roll 5 is precisely positioned by those rolls 3 and 4. Web 1 passes now from roll 3 to slender roll 5 and then to winding roll 2. The axis of slender roll 5 and the axis of winding roll 2 are preferably contained in a substantially vertical plane. This situation is illustrated in FIG. 1*d*.

Figure 1D:
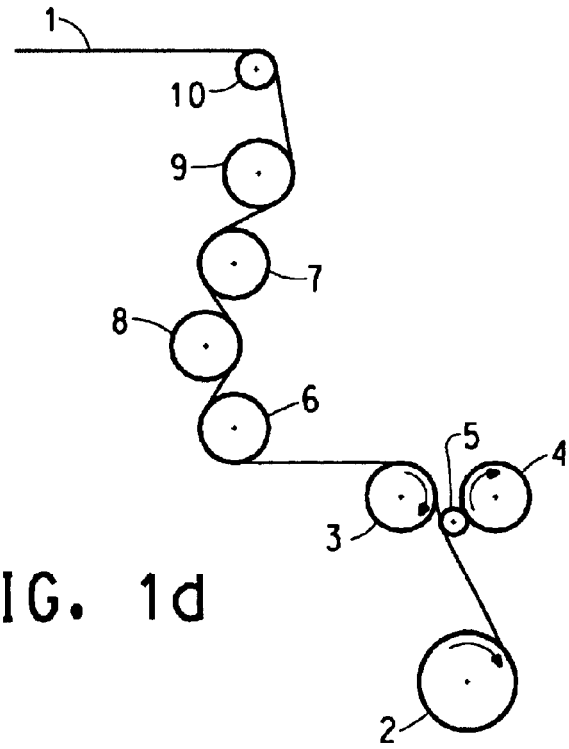
Figure 1E:
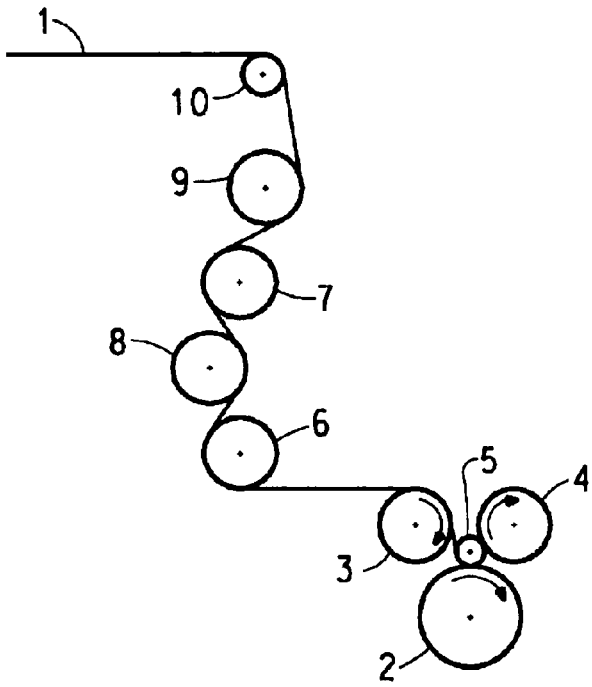
Figure 1F:
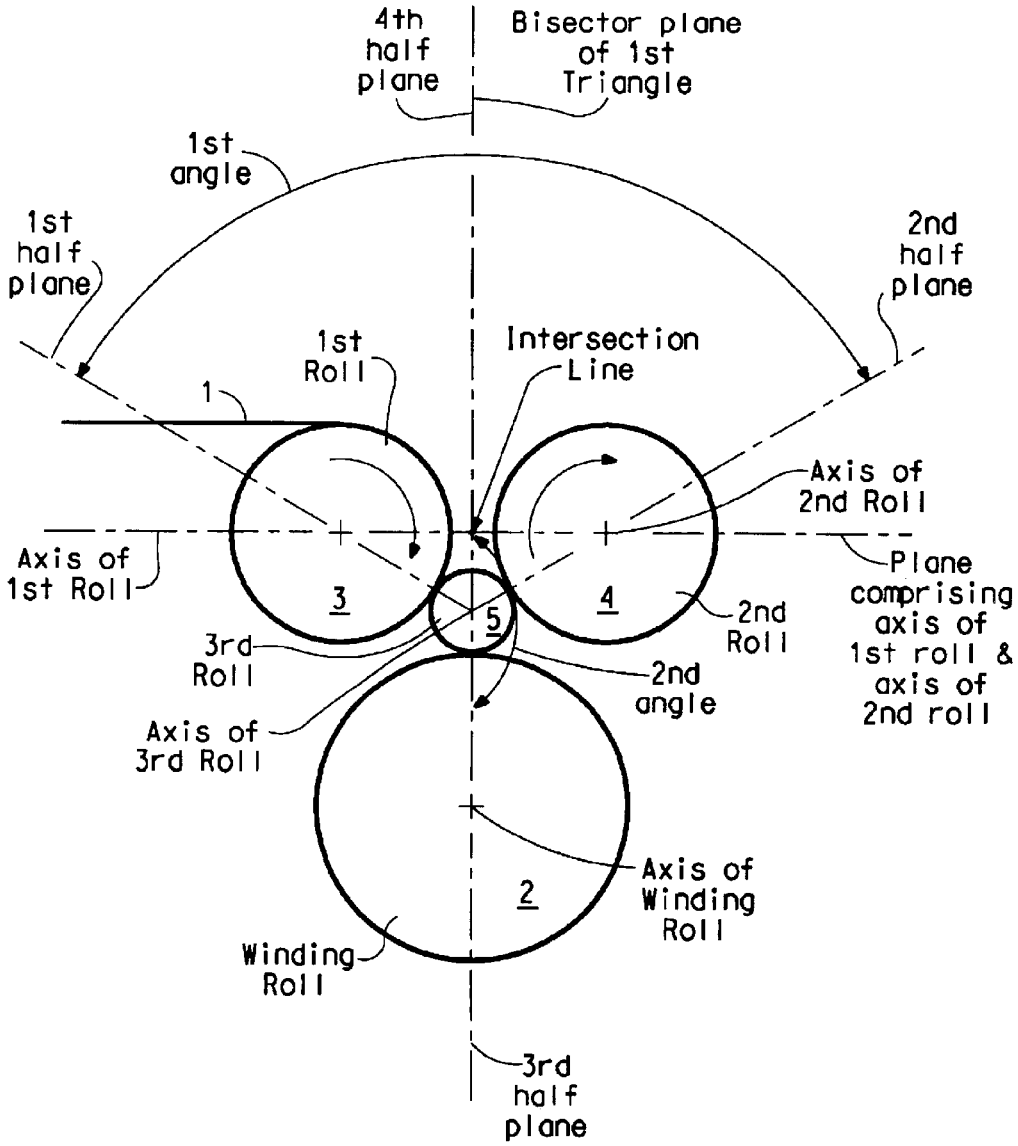
FIG. 1*f* illustrates the angles, planes and intersection lines regarding the apparatus of FIGS. 1*a* to 1*e*.

Once at the stage of FIG. 1*d*, the block formed by carriages 11 and 12 is lowered (i.e. the whole roll assembly) till slender roll 5 abuts winding roll 2, preferably at its top. This situation is illustrated in FIG. 1*e*. As it can be taken from FIG. 1*e*, rolls 3 and 4 do not abut winding roll 2. This lowering may be achieved e.g. by a main carriage (not shown) movable vertically, on which carriages 11 and 12 are slidably mounted in the horizontal direction (to allow their displacement towards web 1 mentioned in relation with FIG. 1*a* to FIG. 1*c*). Just before slender roll 5 abuts winding roll 2, preferably at a distance of about 10 millimeters, the driving in rotation of rolls 3 and 4 is preferably stopped so as to act now as idle rolls; this may be classically achieved by disengagement of a clutch mechanism. When the apparatus is in position of FIG. 1*e*, it is in nominal position for winding efficiently web 1 on winding roll 2 and slender roll 5 acts as a nip roller.

During each of these steps from FIG. 1*a* to FIG. 1*e*, the rotation speed of winding roll 2 is preferably varied so as to keep a substantially constant tension of web 1 as the length of the path of web 1 varies during the deviation of web 1 by the various rolls of the apparatus. For instance, this may be achieved by controlling the rotation speed of winding roll 2 as a function of the force exerted by web 1 on roll 6, during the steps described in relation with FIGS. 1*c*, 1*d* and 1*e*.

Figure 2:
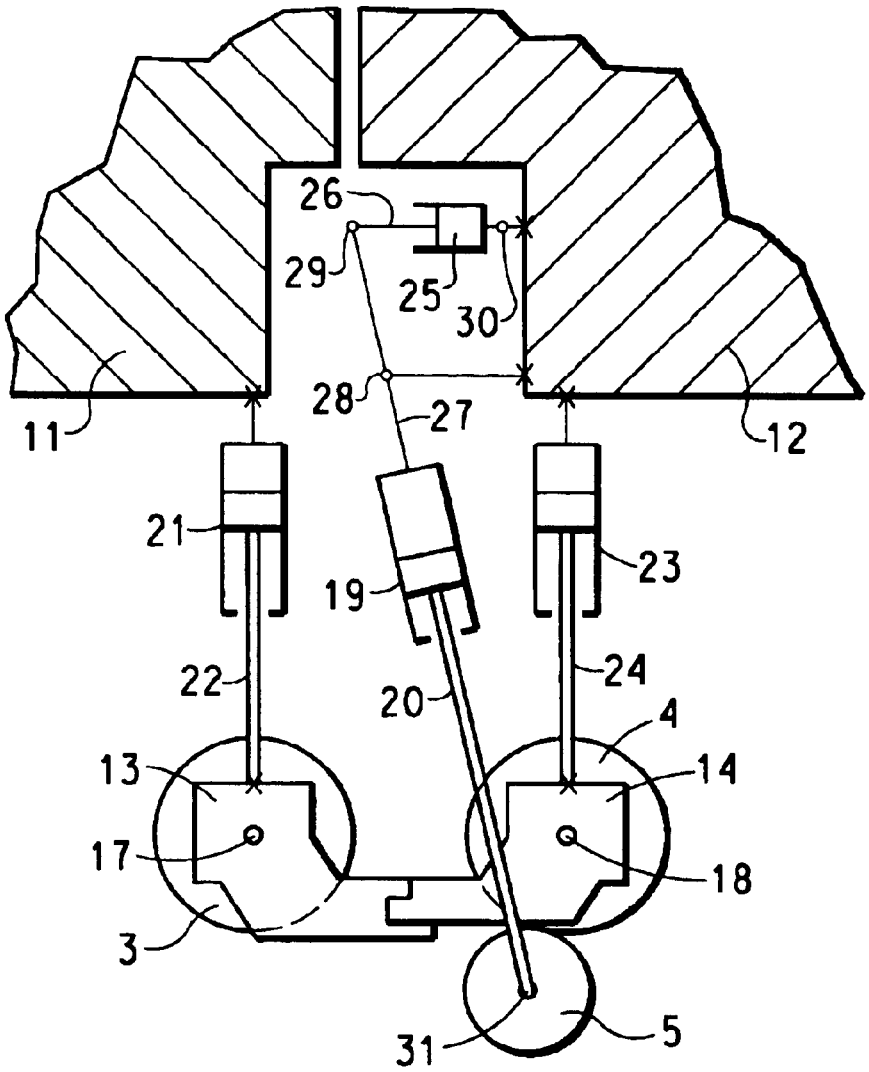
FIG. 2 is a schematic side view showing the mechanical links between the rolls and the carriages.

Referring now to FIG. 2, we will now describe the mechanism for ensuring the correct positioning of slender roll 5 between rolls 3 and 4. FIG. 2 shows only a part of the apparatus relatively to rolls 3 and 4 and slender roll 5 when the apparatus is in the position of FIG. 1*c*. Slender roll 5 (its axis is referenced 31) is held on each end through a corresponding double acting pressure cylinder 19. More precisely, each end of slender roll 5 is articulated on the end of the rod 20 of a respective pressure cylinder 19. Pressure cylinders 19 preferably extend substantially vertically with their rods 20 extending downwards. Each pressure cylinder 19 is preferably fixed on the end of a respective arm 27 which is linked to carriage 12 via a respective pivot link 28. Pivot links 28 are preferably arranged in the middle region of arms 27. The opposed end of each arm 27 is linked on the rod 26 of a respective pressure cylinder 25 via a pivot link 29. Pressure cylinders 25 are both linked on carriage 12 via respective pivot links 30. Pressure cylinders 25 preferably extend substantially horizontally. This construction allows to change the horizontal and vertical position of slender roll 5 by controlling pressure cylinders 19 and 25. Thus, when passing from the position of FIG. 1*b* to the position of FIG. 1*c*, slender roll 5 is positioned correctly under roll 4, i.e. without slender roll 5 abutting web 1, by causing rods 20 and 26 of pressure cylinders 19 and 25 to the extended position. Then, to pass from the position of FIG. 1*c* to the position of FIG. 1*d*, rods 20 are caused to retract and thus, slender roll 5 runs along the circumference of roll 4 until it abuts also roll 3 through web 1; during this operation, pressure in pressure cylinders 25 is controlled in known manner in order to maintain slender roll 5 in abutment on roll 4 without excessive strength. Preferably, once slender roll 5 abuts roll 3, no pressure is anymore applied to pressure cylinder 25 so that slender roll 25 is positioned only by rolls 3 and 4 through the pulling forces of pressure cylinders 19.

During winding, i.e. in the position of FIG. 1*e*, pressure cylinders 19 remain retracted to keep both ends of slender roll 5 in abutment with rolls 3 and 4 regardless of the width of winding roll 2.

As regards rolls 3 and 4, they are both rotatably mounted on respective supports 13 and 14, their axis being referenced 17 and 18. Supports 13 and 14 cooperate so as to define an interlocking mechanism for interlocking roll 3 with roll 4 as already mentioned: this will be described more precisely in relation with FIG. 3. Supports 13 are slidably mounted in the vertical direction on carriage 11 (the guiding means are not shown) and are vertically positioned through e.g. double acting pressure cylinders 21. Similarly, supports 14 are slidably mounted in the vertical direction on carriage 12 (the guiding means are not shown) and are vertically positioned through e.g. pressure cylinders 23. So, pressure cylinders 21 and 23 extend parallel and vertically with their respective rods 22 and 24 extending downwards. Pressure cylinders 19, 20 and 21 automatically take up the diameter increase of winding roll 2. However, they are only used for to lift rolls 3 and 4 and slender roll 5 over a defined detected distance corresponding to e.g. a few millimeters. After that, it is the whole block formed of carriages 11 and 12 which is lifted over said defined height and blocked in this new position while pressure cylinders 19, 21 and 23 maintain rolls 3 and 4 in abutment with slender roll 5 and slender roll 5 in abutment with winding roll 2. From there on, pressure cylinders 19, 21 and 23 again take up the diameter variation of winding roll 2 until being retracted again from said defined distance after which the whole block is again lifted and so on.

Figure 3:
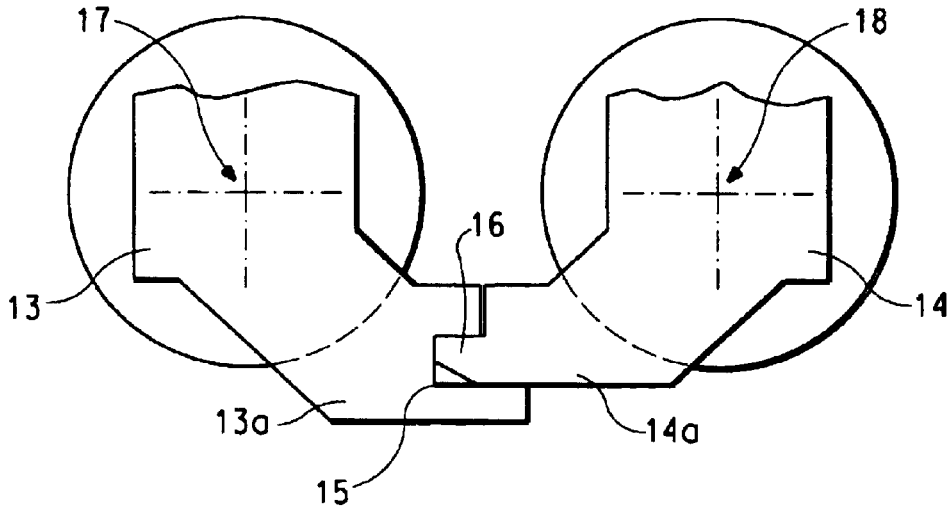
FIG. 3 is a schematic side view of the lower parts of the supports which interlock.

Referring to FIG. 3, we will now describe the interlocking mechanism of roll 3 with roll 4 which is active in the state of the apparatus shown in FIGS. 1*c* to 1*e*. FIG. 3 is a schematic side view showing the lower part of support 13 carrying roll 3 (its axis being referenced 17) and the lower part of support 14 carrying roll 4 (its axis being referenced 18). The lower part of support 13 exhibits an arm 13*a* extending laterally towards support 14. A groove 15 is arranged at the free end of arm 13*a*. The lower part of support 14 exhibits an arm 14*a* extending laterally towards support 13. A nose 16 is arranged on the free end of arm 14*a*. The shape of the free end of arm 14*a* matches the shape of the free end of arm 13*a* and, more particularly, nose 16 fits groove 15. Nose 16 has preferably a beveled edge to facilitate the engagement with groove 15. Thus, when the apparatus comes to the position of FIG. 1*c*, support 13 and support 14 interlock. Furthermore, both supports 13 and 14 are maintained interlocked e.g. by way of means acting on carriages 11 and 12 so as to avoid lateral disengagement from one another. In this way, both supports 13 and 14 form one rigid block: horizontal or vertical relative vibrations between support 11 and support 12 are eliminated.

We will now describe the relationship between rolls 3 and 4, slender roll 5 and winding roll 2 from the mechanical point of view. When the apparatus is in the position of FIG. 1*e*, i.e. the nominal position for winding efficiently, slender roll 5 acts as a nip roller. The diameter of slender roll 5 is preferably as small as possible in order to minimize the air entrainment between web 1 and winding roll 2. Thus, slender roll 5 becomes flexible over its length and, in the absence of rolls 3 and 4, may bend and vibrate on winding roll 2 while winding. Resonance may even occur. Both, the bending and vibrating of slender roll 5 would adversely result in tangential speed differences between slender roll 5 and winding roll 2 inducing friction on web 1, variations of tension in web 1 and bad effects as regard the spreading of web 1 as well as regards the air entrainment. Thus, it is preferred to avoid the bending and vibrating of slender roll 5 while winding. For that purpose, rolls 3 and 4 flank slender roll 5 on its upper half circumference so as to sandwich it between them and winding roll 2 while winding. Further, rolls 3 and 4 are preferably more rigid than slender roll 5 in order to be able to support slender roll 5: that is preferably obtained with rolls 3 and 4 having a greater diameter than slender roll 5. Rolls 3 and 4 preferably have each a diameter being one to six times, preferably three times, the diameter of slender roll 5. Preferably, rolls 3 and 4 have the same diameter and are positioned at the same vertical level. Further, the surface of roll 3, which is wrapped by web 1 (in this embodiment), is advantageously smooth; preferably, its surface is metallic and polished, its roughness Rt (i.e. the difference between the highest and lowest point of the surface) being lower or equal to 25 $\mu$m. In that case, web 1 floats on the aerodynamic boundary layer without contacting the surface of roll 3. This results in a spreading effect. Similarly, the surface of roll 4 is advantageously smooth similarly to roll 3. Slender roll 5 consists preferably in a core with an elastic coating which conforms itself to the surface of winding roll 2. For slender roll 5 having a width up to 2 meters and web 1 being conveyed at a speed up to 1000 meters/min, it is advantageous for slender roll 5 to have a diameter of about 50 millimeters and for rolls 3 and 4 to have a diameter of about 150 millimeters each. Thus, rolls 3 and 4 allow to position precisely slender roll 5 between them and, as a consequence, slender roll 5 is correctly positioned on winding roll 2 and further, rolls 3 and 4 provide dynamic stability while winding.

The distance between slender roll 5 and winding roll 2 in FIG. 1*d* is preferably small so that the time needed to pass from the position of FIG. 1*d* to the position of FIG. 1*e* is low, and thus, it limits the time during which slender roll 5 may possibly bend or vibrate under rolls 3 and 4 as it is not in abutment with winding roll 2 yet. The mechanism for ensuring the correct positioning of slender roll 5 between rolls 3 and 4 will be more precisely described in relation with FIG. 3.

Since supports 13 and 14 are preferably interlocked when arriving in position of FIG. 1*c* as already mentioned and remain interlocked in the subsequent steps (corresponding to FIGS. 1*d* and 1*e*), relative movement, more particularly vibrations, between rolls 3 and 4 are avoided while winding and thus, it avoids unwished bending and vibrations of slender roll 5 that may be induced by said relative movement or vibrations between rolls 3 and 4.

Further, the apparatus is designed so as to avoid, when in position of FIG. 1*e*, lateral movement, more particularly lateral vibrations, of the block formed by carriages 11 and 12 with their supports 13 and 14 being interlocked, and thus of rolls 3 and 4 and slender roll 5, relatively to winding roll 2. However, the vertical position of the unit formed by rolls 3 and 4 and slender roll 5 adapts to the diameter of winding roll 2 while increasing during the winding as it was described in relation with FIG. 2. Pressure cylinders 21 and 23 are preferably of pneumatic type in order to define an adjustable contact pressure between winding roll 2 and slender roll 5 and to absorb the eventual vertical vibrations. Pressure cylinders 19 are also preferably of the pneumatic type. As already mentioned, web 1 preferably passes substantially horizontally from roll 6 to roll 3 so that eventually remaining vertical movements or vibrations of roll 3 and slender roll 5 (due to the run out of winding roll 2) do not cause substantial variation of tension in web 1 as it would be the case if web 1 is fed vertically to roll 3.

In the position of FIG. 1*e*, efforts relative to slender roll 5 are distributed as follows.

The weight W of rolls 3 and 4 (which are interlocked) is supported by winding roll 2 via slender roll 5. Roll 3 and roll 4 have preferably the same weight. However, at least a small amount $\Delta W$ of their weight W is preferably supported by pressure cylinders 21 and 23 disposed at each end of said rolls 3 and 4, said pressure cylinders pulling upwards half of that amount, i.e. $\Delta W/2$, at each end. Preferably, amounts $\Delta W$ are selected so as to be sufficient for obtaining that the pressure exerted by slender roll 5 on winding roll 2 is maximal in the middle of slender roll 5 and decreases progressively towards its edges. Nevertheless, the pulling forces $\Delta W/2$ of pressure cylinders 21 and 23 are limited so that slender roll 5 remain in abutment with winding roll 2 over the whole width of web 1. As a consequence, the efficiency of slender roll 5 for diminishing the air entrainment between web 1 and winding roll 2 is further improved as it favors the expulsion of the air caught between web 1 and winding roll 2 from the middle towards the edges of web 1 in the abutment region of slender roll 5 with winding roll 2. In practice, the pulling upward force of $\Delta W/2$ developed by pressure cylinders 21 and 23 on each end are preferably obtained by feeding pressure cylinders 21 and 23 of a differential type (at each end) with a first pressure (a) inducing an upward constant force of $W/2$ and with a second pressure (b) inducing a downward force of $(W/2-\Delta W/2)$: thus, the resultant force on each end of rolls 3 and 4 is $\Delta W/2$ directed upwards.

As regards the abutment of slender roll 5 on rolls 3 and 4, the reaction forces of slender roll 5 on rolls 3 and 4 due to at least a part of the weight of rolls 3 and 4 supported by winding roll 2 via slender roll 5 are preferably maintained as low as possible, rolls 3 and 4 just avoiding the bending and vibrating of slender roll 5 as well as ensuring its correct positioning. Thus, compression of web 1 between slender roll 5 and roll 3 is maintained low and, as a result, avoids to harm web 1. From that point of view, the angle between the half-plane delimited by the axis of slender roll 5 and comprising the axis of roll 3 and the half-plane delimited by the axis of slender roll 5 and comprising the axis of roll 4 is preferably as low as possible, e.g. 130°. As a result, the efforts of slender roll 5 on rolls 3 and 4 are minimized for a given effort exerted from winding roll 2 on slender roll 5 if relevant.

In practice, winding roll 2 bows slightly downward due to its own weight and due to the fact it is supported on its ends. However, if designed properly, winding roll 2 is more rigid than slender roll 5 and rolls 3 and 4, and consequently, winding roll 2 bows less downward than slender roll 5 and rolls 3 and 4. So, in fact, rolls 3 and 4 and slender roll 5 bow the same amount as winding roll 2 which continues to support slender roll 5 at least over the width of web 1 as previously described. However, it is preferred that pressure cylinders 19 develop an upward force at each end of slender roll 5 sufficient for ensuring that both end regions of slender roll 5 abut rolls 3 and 4 for any width of winding roll 2.

It is preferred that slender roll 5 abuts the top of winding roll 2 as shown in FIG. 1*e* (or, in another embodiment, that winding roll 2 abuts the top of slender roll 5). Thus, the tangential speed of winding roll 2 and slender roll 5 as well as the tangential speed of slender roll 5 and roll 3 are substantially identical for each point on the width of web 1, and so no frictions on web 1 are generated. This is not obtained if slender roll 5 abuts laterally winding roll 2, (thus, rolls 3 and 4 flank slender roll 5 laterally). Indeed, rolls 3 and 4 bow each downward of substantially a same fixed amount (if they are identically designed) and winding roll 2 bows downward with another amount which furthermore varies as its diameter increases due to web 1 wound on it. As a consequence, rolls 3 and 4 do not position correctly slender roll 5 on winding roll 2 over its whole length and it results in differences of tangential speed vectors between roll 3 and slender roll 5 and between slender roll 5 and winding roll 2, thus inducing friction on web 1. Further, slender roll 5 may even slightly vibrate as slender roll 5 is no more correctly sandwiched on all its length between rolls 3 and 4 on one hand and winding roll 2 on the other hand.

Figure 4:
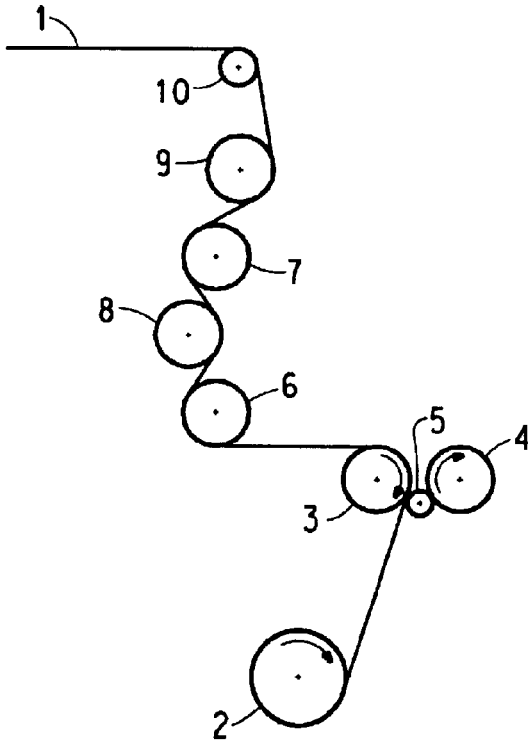
FIG. 4 is a schematic side view for an alternative embodiment of the invention.

In another preferred embodiment, it is proposed the same apparatus as the one described up to now, but with modified steps compared to those of FIG. 1*a* to FIG. 1*e*. Initial position of the apparatus is the one of FIG. 1*a*. Displacement of first carriage 11 and second carriage 12 are similarly executed than described previously for passing from FIG. 1*a* to FIG. 1*c*, but lateral displacement distances are modified so that the apparatus reaches the state of FIG. 4 instead of the one of FIG. 1*c*. Then, slender roll 5 is moved along roll 4 until it contacts roll 3, as previously described for passing from FIG. 1*c* to FIG. 1*d*. Then, the block formed by first carriage 11 and second carriage 12 (with their supports 13 and 14 being interlocked as previously) is laterally shifted in order to go in the position of FIG. 1*d* and then, to the position of FIG. 1*e*.

Figure 5:
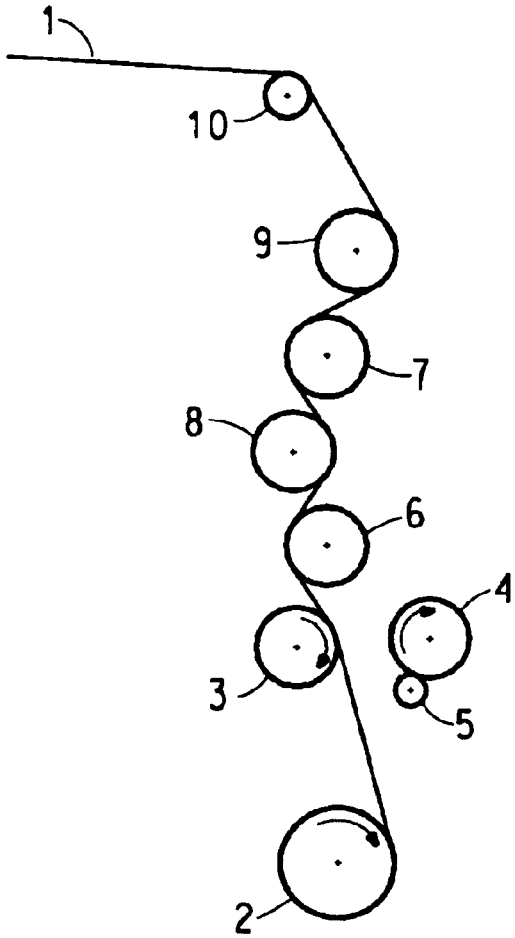
FIG. 5 is a schematic side view for another alternative embodiment of the invention.

In a further preferred embodiment, it is proposed a similar apparatus which allows to gain space following the horizontal direction. In the embodiment shown in relation with FIGS. 1*a* to 1*e*, roll 3 is laterally shifted with respect to rolls 8 and 9 which are shown substantially vertically aligned. Similarly, roll 4 and slender roll 5 are laterally shifted with respect to rolls 6 and 7 which are also shown substantially aligned. Thus, when the apparatus is in open state as in FIG. 1*a*, it takes some place in the horizontal direction. It is for example possible to mount roll 3 on one carriage and rolls 8 and 9 on a further carriage, both being movable laterally. Similarly, roll 4 and slender roll 5 may be mounted on one carriage while rolls 6 and 7 are mounted on a further carriage, both being movable laterally. Thus, when the apparatus is in open condition as illustrated in the previous embodiment by FIG. 1*a*, it is possible to align approximately vertically rolls 3, 8 and 9 on one side of the path of web 1 between idle roll 10 and winding roll 2 and it is possible to align approximately vertically rolls 3, 8 and 9 on the other side of said path. Thus, it is possible to spare the horizontal distance previously separating rolls 8 and 9 from roll 3 and the horizontal distance separating roll 4 and slender roll 5 from rolls 6 and 7. Then, both carriages carrying roll 3 and rolls 8 and 9 may be simultaneously moved toward web 1 to abut it and then (or eventually simultaneously) both carriages carrying roll 4, slender roll 5 and rolls 8 and 9 may be simultaneously moved toward web 1 until rolls 3 and 4 and slender roll 5 are in the position previously illustrated in FIG. 1*c*. At this stage, rolls 8 and 9 and rolls 6 and 7 form the previously mentioned jaw closed on web 1, but said jaw is then substantially vertically aligned with rolls 3 and 4 and slender roll 5 as shown in FIG. 5. Roll 6 is slightly above rolls 3 and 4 as regards the vertical position. From this position on, the carriage of rolls 8 and 9 and the carriage 6 and 7 are simultaneously shifted in the horizontal direction to get to the position depicted in FIG. 1*c* and then the subsequent steps of the previous embodiment are normally carried out. However, before operating said shift, it is possible to realize previously the step described for passing from the position of the apparatus described in FIG. 1*c* to the position of FIG. 1*d* in the previous embodiment.

In the different embodiments described previously, when the apparatus is in the nominal winding position (i.e. position shown in FIG. 1*e*), web 1 passes between roll 3 and slender roll 5 and then between slender roll 5 and winding roll 2. Alternately, it is possible to thread up web 1 through a different path in the device comprising rolls 3 and 4 and slender roll 5 for winding web 1 on winding roll 2.

Figure 6A:
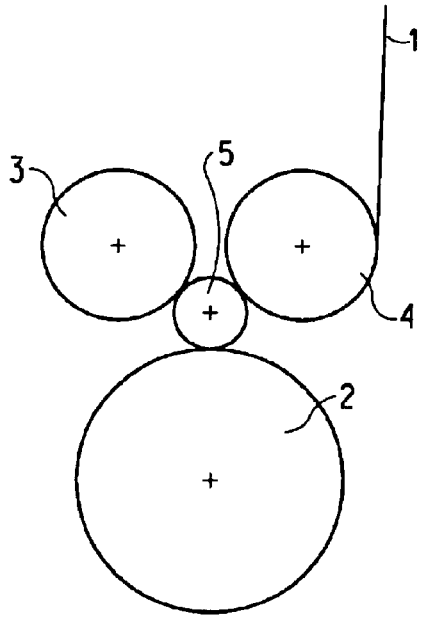
FIGS. 6*a* and 6*b* show alternative possibilities to thread up the web through the rolls of an apparatus according to the invention.

For instance, as shown in FIG. 6*a*, web 1 may first pass between roll 4 and slender roll 5, then between roll 3 and slender roll 5 and finally between slender roll 5 and winding roll 2. In this case, the apparatus has preferably an open position in which slender roll 5 is located on one side of the path of web 1 in course of winding on winding roll 2 and rolls 3 and 4 are located on the other side of the path of web 1 in course of winding on winding roll 2. Then, when the apparatus is caused to move to its nominal winding position (e.g. by moving rolls 3 and 4 and slender roll 5 towards winding roll 2 the location of which may be fixed, or by moving slender roll 5 and winding roll 2 towards rolls 3 and 4 the location of which may be fixed), web 1 will be accordingly threaded up.

Figure 6B:
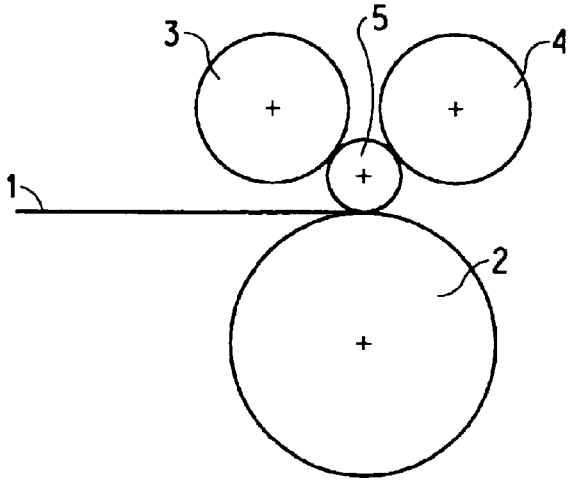

As shown in FIG. 6*b*, web 1 may also directly pass between slender roll 5 and winding roll 2, without passing between roll 3 and slender roll 5 or between roll 4 and slender roll 5. In this case, the apparatus has preferably an open position in which rolls 3 and 4 and slender roll 5 are all located on a same side of the path of web 1 in course of winding on winding roll 2. Further, rolls 3 and 4 and slender roll 5 preferably have their relative locations already corresponding to those in the nominal winding position. Then, when the apparatus is caused to move to its nominal winding position (e.g. by moving rolls 3 and 4 and slender roll 5 towards winding roll 2 the location of which may be fixed, or by moving winding roll 2 towards slender roll 5 and rolls 4 and 5 the location of which may be fixed), web 1 will be accordingly threaded up.

In the embodiments of FIGS. 6*a* and 6*b*, the apparatus preferably still has means for positioning automatically slender roll 5 between rolls 3 and 4 in the nominal winding position. Further, in case winding roll 2 is movable, it is preferably winding roll 2 which moves during winding in the nominal winding position, in order to adapt to the diameter of winding roll 2.

In the embodiments described in relation with FIG. 1 to 5, web 1 passes between roll 3 and slender roll 5 and then between slender roll 5 and winding roll 2, when the apparatus is in the nominal winding position. Further, rolls 3 and 4 and slender roll 5 are movable from the open position to the nominal winding position, the location of winding roll 2 being fixed. There are alternate possibilities to define the rolls the location of which is fixed or movable in order to allow an easy thread up. For instance, it is possible to have the location of roll 4 and slender roll 5 being fixed (however, the apparatus preferably still has means for positionning automatically slender roll 5 between rolls 3 and 4 in said nominal winding position) and roll 3 and winding roll 2 movable in order to get into the nominal winding position. Then, it is preferably winding roll 2 which moves during winding in the nominal winding position, in order to adapt to the diameter of winding roll 2.

It is to be understood that in the described embodiments of the invention, the three roll system comprising rolls 3 and 4 and slender roll 5 for winding web 1 on winding roll 2 may be used independently from the jaw formed by rolls 6, 7, 8 and 9.

Of course, the invention is not limited to the embodiments described above.

What is claimed is:

1. An apparatus for winding at least one web on a winding roll comprising at least a first roll, a second roll 4 and a third roll parallel to one another and to said winding roll, said apparatus having a nominal winding position in which:

said first and second rolls and said winding roll are each in contact with said third roll;

there is no contact between said first roll and said second roll, between said first roll and said winding roll and between said second roll and said winding roll;

a first angle defined between a first half-plane delimited by the axis of said third roll and comprising the axis of said first roll and a second half-plane delimited by the axis of said third roll and comprising the axis of said second roll is smaller than 180°;

a second angle defined between a third half-plane delimited by the axis of said third roll and comprising the axis of said winding roll and a fourth half-plane delimited by the axis of said third roll and comprising an intersection line is greater than 90°, said intersection line being defined as the intersection between the bisector plane of said first angle and the plane comprising the axis of said first roll and the axis of said second roll;

and the apparatus further comprises means for causing said third roll to position and align freely between said first and second rolls and said winding roll when said apparatus is in said nominal winding position.

2. The apparatus according to claim 1, wherein said first, second and third rolls and said winding roll have each bearings and said apparatus has further an open position in which said first, second and third rolls are located out of the path of said web in course of winding on said winding roll the bearings of at least one roll among said first, second and third rolls and said winding roll being movable to enable the change of position from said apparatus between said open position and said nominal winding position.

3. The apparatus according to claim 1, in said nominal winding position, said second angle is substantially 180°.

4. The apparatus according to claim 1, wherein, in said nominal winding position, said third half-plane is substantially vertical.

5. The apparatus according to claim 1, wherein said third roll has bearings and loading means apply forces on the bearings of said third roll so that the end regions of said third roll abut said first and second rolls for any width of said winding roll when said apparatus is in said nominal winding position.

6. The apparatus according to claim 1, wherein said first, second and third rolls and said winding roll have each bearings, the apparatus further comprising means for moving the bearings of said first, second and third rolls along a common direction not perpendicular to said third half-plane, in order to adapt to the diameter of said winding roll when said apparatus is in said nominal winding position, the bearings of said winding roll being held fixed in said nominal winding position.

7. The apparatus according to claim 6, comprising interlocking means for selectively interlocking the bearings of said first and second rolls so that said first and second rolls are not free to move with respect to each other but together.

8. The apparatus according to claim 6, comprising loading means for acting on the bearings of said first and second rolls with a force having a component parallel to said third half-plane and directed towards said winding roll in order to press said third roll against said winding roll when said apparatus is in said nominal winding position.

9. The apparatus according to claim 6, in wherein, in said nominal winding position, the axis of said third roll is located at a higher level than the axis of said winding roll and that the weight of said first, second and third rolls is at least partly supported by said winding roll via said third roll whereby said third roll exerts a pressure on said winding roll.

10. The apparatus according to claim 9, comprising loading means for acting on the bearings of said first and second rolls with a force having a component parallel to said third half-plane and directed away from said winding roll so that only a part of the weight of said first and second rolls is supported by said winding roll when said apparatus is in said nominal winding position.

11. The apparatus according to claim 9, comprising loading means for acting on the bearings of said first and second rolls with a force having a component parallel to said third half-plane and directed away from said winding roll so that the pressure applied by third roll on winding roll is maximal in the middle region of said winding roll and diminishes progressively towards its edges when said apparatus is in said nominal winding position.

12. The apparatus according to claim 1, wherein said first and second rolls and said winding roll have each bearings, the apparatus further comprising means for moving the bearings of said winding roll along a common direction not perpendicular to said third half-plane and preferably parallel to said third half-plane, in order to adapt to the diameter of said winding roll when said apparatus is in said nominal winding position, the bearings of said first and second rolls being held fixed in said nominal winding position.

13. The apparatus according to claim 1, wherein for each roll among said first and second rolls coming in contact with said web it comprises means for selectively causing said roll either to rotate in a direction and at a tangential speed substantially corresponding to those of said web (1), or to act as an idle roll.

14. The apparatus according to claim 1, comprising means for selectively causing at least said first or second roll either to act as an idle roll, or to rotate in a direction and at a speed whereby, when said third roll is in direct contact with said first or second roll, said third roll is driven in rotation by friction in a direction and at a tangential speed substantially corresponding to those of said web (1).

15. The apparatus according to claim 1, comprising means for causing said third roll to run along the circumference of said second roll until said third roll abuts also said first roll.

16. The apparatus according to claim 1, wherein the diameter of said first and second rolls is one to six times the diameter of said third roll.

17. The apparatus according to claim 16, wherein said first and second rolls have the same diameter.

18. The apparatus according to claim 17, wherein said first and second rolls have the same weight.

19. The apparatus according to claim 16, wherein, in said nominal winding position, said second angle is substantially 180° and said third half-plane is substantially vertical.

20. The apparatus according to claim 19, wherein said first and second rolls have the same diameter.

21. The apparatus according to claim 20, wherein said first and second rolls have the same weight.

22. A method for winding at least one web on a winding roll, using an apparatus according to claim 2, comprising the step of (i) causing said apparatus to adopt said open position;

(ii) initiating the winding of said web on said winding roll;

(iii) bringing said winding roll and said first, second and third rolls nearer until they adopt said nominal winding position.

23. A method according to claim 22, wherein step (iii) comprises:

causing each roll among said first and second rolls coming into contact with said web, to rotate before contacting said web in the direction and at a tangential speed corresponding substantially to those of said web.

24. A method according to claim 23, wherein step (iii) comprises:

causing said first roll and said second roll to act as an idle roll before said third roll and said winding roll come into contact.

25. A method for winding at least one web on a winding roll, using an apparatus according to claim 2, comprising the steps of:

(i) causing said apparatus to adopt said open position in which said first, second and third rolls are located at one side of the path of said web towards said winding roll (ii) initiating the winding of said web on said winding roll;

(iii) bringing said winding roll and said first, second and third rolls nearer until they adopt said nominal winding position in which said web passes between said third roll and said winding roll, but neither between said second and third rolls, nor between said first and third rolls.

26. A method for winding at least one web on a winding roll, using an apparatus according to claim 2, comprising the steps of:

(i) causing said apparatus to adopt said open position in which said first and second rolls are located at one side of the path of said web towards said winding roll and said third roll is located on the other side of the path of said web towards said winding roll (ii) initiating the winding of said web on said winding roll;

(iii) bringing said winding roll and said first, second and third rolls nearer until they adopt said nominal winding position in which said web passes between said second and third rolls, then between said first and third rolls and finally between said third roll and said winding roll.

27. A method for winding at least one web on a winding roll, using an apparatus according to claim 2, comprising the steps of:

(i) causing said apparatus to adopt said open position in which said first roll is located on one side of the path of said web towards said winding roll and said second and third rolls are located on the other side of the path of said web towards said winding roll;

(ii) initiating the winding of said web on said winding roll;

(iii) bringing said winding roll and said first, second and third rolls nearer until they adopt said nominal winding position in which said web passes between said first and third rolls and then between said third roll and said winding roll, but not between said second roll and said third roll.

28. A method according to claim 27, wherein step (iii) comprises the two substeps of:

(a) bringing said first, second and third rolls nearer until a predetermined configuration in which said third roll is in contact with said first roll and said second roll, said third roll not being in contact with said winding roll; and (b) bringing said winding roll and a unit formed by said first, second and third rolls in said predetermined configuration nearer until said third roll is in contact with said winding roll.

29. The method according to claim 28, wherein substep (a) comprises the two substeps of:

(aa) bringing said first, second and third rolls nearer until another predetermined configuration in which said first roll and said second roll are spaced of a predetermined distance and said third roll is not in contact with said first roll; and (bb) bringing said third roll nearer said first and second-rolls until said third roll is in contact with said first and second rolls.

30. The method according to claim 29, wherein substep (bb) comprises the substep of:

causing said second roll to rotate and said third roll to run along the circumference of said second roll wherein said second roll causes said third roll to rotate by friction driving in the direction and at a tangential speed corresponding substantially to those of said web.

31. An apparatus for winding at least one web, on a winding roll, comprising at least a first roll, a second roll and a third roll parallel to one another and to said winding roll, the diameter of said first and second rolls being one to six times the diameter of said third roll and said apparatus having a nominal winding position in which:

said first and second rolls and said winding roll are each in contact with said third roll;

there is no contact between said first roll and said second roll, between said first roll and said winding roll and between said second roll and said winding roll;

a first angle defined between a first half-plane delimited by the axis of said third roll and comprising the axis of said first roll and a second half-plane delimited by the axis of said third roll and comprising the axis of said second roll is smaller than 180°; and a second angle defined between a third half-plane delimited by the axis of said third roll and comprising the axis of said winding roll and a fourth half-plane delimited by the axis of said third roll and comprising an intersection line is greater than 90°, said intersection line being defined as the intersection between the bisector plane of said first angle and the plane comprising the axis of said first roll and the axis of said second roll.

32. The apparatus according to claim 31, wherein said first and second rolls have the same diameter.

* * * * *